US012201234B2

(12) United States Patent
Johnston

(10) Patent No.: US 12,201,234 B2
(45) Date of Patent: Jan. 21, 2025

(54) INSULATING FILL MATERIAL

(71) Applicant: BESPOKE FABRICS LTD, Elgin (GB)

(72) Inventor: Joan Johnston, Elgin (GB)

(73) Assignee: BESPOKE FABRICS LTD, Elgin (GB)

( * ) Notice: Subject to any disclaimer, the term of this patent is extended or adjusted under 35 U.S.C. 154(b) by 299 days.

(21) Appl. No.: 17/613,875

(22) PCT Filed: May 22, 2020

(86) PCT No.: PCT/IB2020/054896

§ 371 (c)(1),
(2) Date: Nov. 23, 2021

(87) PCT Pub. No.: WO2020/240384

PCT Pub. Date: Dec. 3, 2020

(65) Prior Publication Data

US 2022/0240613 A1 Aug. 4, 2022

(30) Foreign Application Priority Data

May 24, 2019 (GB) ..... 1907405

(51) Int. Cl.
*A47G 9/02* (2006.01)

(52) U.S. Cl.
CPC ..... *A47G 9/0207* (2013.01); *Y10T 428/237* (2015.01)

(58) Field of Classification Search
None
See application file for complete search history.

(56) References Cited

U.S. PATENT DOCUMENTS

| | | | | |
|---|---|---|---|---|
| 3,579,744 A | | 5/1971 | Menzies, Jr. | |
| 5,286,556 A | | 2/1994 | Tesch | |
| 5,443,893 A | * | 8/1995 | Herzberg | B32B 5/06 442/364 |

FOREIGN PATENT DOCUMENTS

| | | | |
|---|---|---|---|
| GB | 171173 | A | 11/1921 |
| GB | 599682 | A | 3/1948 |
| KR | 10-2017-0128792 | A | 11/2017 |

OTHER PUBLICATIONS

Shamsaddini-Bafti et al., "Effect of sex and rearing system on the quality and mineral content of fiber from raeini cashmere goats," *J Animal Sci Biotechnol* 3(20), 2012, 6 pages.

* cited by examiner

*Primary Examiner* — Alexander S Thomas
(74) *Attorney, Agent, or Firm* — Seed IP Law Group LLP

(57) ABSTRACT

The invention provides an insulating fill material comprising a blend of fibres, the fibres comprising cashmere guard hair. The fill material typically includes at least 50% cashmere guard hair. The blended fibres are preferably formed into a non-woven web, which is lapped to provide a plurality of layers (101). The invention also provides products incorporating the fill material, such as bedding and garments.

10 Claims, 2 Drawing Sheets

INSULATING FILL MATERIAL

TECHNICAL FIELD

The present invention relates generally to insulating fill materials, in particular (but not necessarily exclusively) fill materials for bedding products (e.g. duvets, quilts, pillows and the like) and garments (e.g. coats such as quilted jackets), and to products incorporating the fill material.

BACKGROUND

Duvets, quilts and the like typically include a fill material sandwiched between two fabric cover layers (sometimes referred to as a "shell"). Quilted jackets have a similar form. Known fill materials include synthetic materials and natural materials, with natural materials generally being considered better quality and more breathable than synthetic materials, as well as being better for the environment and, therefore, favoured.

The more common natural fill materials tend to be down, feathers and wool. The selection of fill material type and quantity will generally determine the warmth and weight of the finished product. Especially for duvets and quilts, fuller fills are often preferred as they feel more effective, so are considered "cosier". Weightier duvets tend to be warmer, which can lead to a conflict between weight and warmth in warmer weather, where a heavier duvet can be too warm but lighter duvets do not feel as "cosy" and may not offer enough warmth.

SUMMARY OF INVENTION

Embodiments of the invention are generally aimed at providing an insulating fill material comprising cashmere guard hair blended with other fibres, preferably natural fibres such as sheep wool or alpaca.

Thus, in a first aspect, the invention provides an insulating fill material comprising a blend of fibres, the fibres comprising cashmere guard hair.

Cashmere guard hair (sometimes referred to as "goat hair") is long, straight hair fibre that comes from the cashmere goat. It is a natural fibre which is considered a by-product of the cashmere industry. The fleece from the cashmere goat is clipped yearly in spring with over 20,000 tonnes of fibre collected annually. Of the fleece removed, less than 30% is used in traditional cashmere production of knitting and weaving; the curly softest fibre that comes from the underbelly of the goat. The remaining 70% is made up of guard hair, dirt and vegetable matter.

Guard hair as a natural fibre has insulating properties. Research has also shown it has anti-bacterial properties and is anti-fungal, as well as being fire retardant. However, because of the straight nature of the fibre, it is not used in traditional knitting or weaving. Currently cashmere guard hair is mainly used in low grade products such as carpet underlay. It is also recognized as a source of keratin and has been used in the absorption of metal ions in water treatment.

The present inventor set out to find a better use for cashmere guard hair and has created a blend of cashmere guard hair and other natural fibres such as wool or alpaca in the form of continuous non-woven web that is an effective insulating material. Relatively high proportions of guard hair can be used with a relatively small proportion of the other natural fibres, such that the resultant product can be considered cashmere based. Taking this approach, the resultant fill material can weigh more than a conventional feather or down filling. This provides benefits for duvets (and other bedding) in particular as it is able to provide a duvet that cocoons the body very well, feeling weighty and cosy, without being overly hot in warmer weather. It also allows the creation of heavier duvets, which some research has suggested could have health benefits by helping with a better night's sleep[1].

The use of cashmere guard hair in the fill material also has environmental benefits as it provides a way of making better use of what might otherwise be considered a waste product of the cashmere industry. As long as there is demand for traditional cashmere, the guard hair will always be a byproduct. In this sense, it is sustainable as well as being natural and biodegradable. The anti-bacterial, anti-fungal and fire-retardant characteristics of the guard hair, noted above, are also beneficial to its use in a fill material for bedding and garments.

In some embodiments of the fill material of the present invention, at least 50% of the blended fibres are cashmere guard hair. In some embodiments at least 60% of the blended fibres https://www.webmd.com/sleep-disorders/news/20180402/seeking-better-sleep-under-a-weighted-blanket are cashmere guard hair. For example, 65% of the blended fibres may be cashmere guard hair. In some embodiments, more than 65% of the fibres may be cashmere guard hairs, although typically at least 10% or more of the fibres will be fibres other than cashmere guard hair to ensure that the relatively fine guard hairs can be bound together in a non-woven web.

Generally, the blended fibres of embodiments of the invention will include at least 20% of fibres other than cashmere guard hair. Some embodiments will include at least 30% of fibres other than cashmere guard hair. In some embodiments it is envisaged that the blended fibres will include about 65% cashmere guard hair and 35% other fibres.

In some embodiments, the other fibres in the blended fill material are other natural fibres, for example animal fibres such as sheep wool (e.g. lambs wool), merino wool or alpaca. The blended fibres may include cashmere guard hair and one other type of fibre or multiple other types of fibre (e.g. other types of natural fibre).

In some embodiments the blended fibres of the fill material are formed into a non-woven web, for example by carding the blended fibres.

In some embodiments, to give the desired depth, weight and/or insulating properties for the fill material, multiple layers of the non-woven web are used, layered on top of one another. The number of layers is generally determined by the required weight of filling, although other factors also come into play, such as the weight/density of each layer. By way of example, a fill material for a light weight duvet might use about 10 layers, and all season duvet might use 25 or more layers and a heavy weight duvet could have as many as 40 layers or more.

Layering the fibre material in this way has been found to provide excellent insulation qualities, providing a duvet that feels dense and firm, without making the final duvet as deep as conventional feather and down duvets, which rely on trapping air in the duvet to give the desired insulating properties.

In a second aspect, the invention provides a product incorporating the fill material of the first aspect. In some embodiments of this second aspect the product may, for example, be a bedding product, such as a duvet, pillow or a quilt. In other embodiments of this second aspect the product may be a garment, for example a coat such as a quilted jacket. Other uses for the fill material include mattresses, bed toppers, pillows, dog mats and childrens' toys for example.

The fill material (e.g. a comprising multiple layers of a non-woven web) will typically be sandwiched between two cover layers, normally fabric cover layers. The cover layers may be formed from a single sheet of material folded over on itself to form an enclosure in which the fill material is contained. Alternatively, the cover layers may be formed from separate sheets of material. The cover layers may be formed from any of a number of suitable fabric materials, including materials conventionally used for cover layers in bedding products (e.g. cotton, cotton blends, silk, silk blends, Linen, bamboo, etc) and garments (e.g. cotton, polyester, nylon, etc). In some products incorporating the fill material, multiple cover layers may be included on one or both sides of the fill material. For example, in a garment the fill material may be sandwiched between two cover layers, over which additional layers are added to provide a desired finish, e.g. with waterproof properties or to add a patterned fabric for example.

DETAILED DESCRIPTION OF THE EMBODIMENT

An embodiment is described below by way of example with reference to the accompanying drawings.

In general terms, embodiments of the invention provide insulating fill materials that comprise a blend of cashmere guard hair with other fibres, preferably natural fibres, examples of which include sheep wool and alpaca.

Figure 1A:
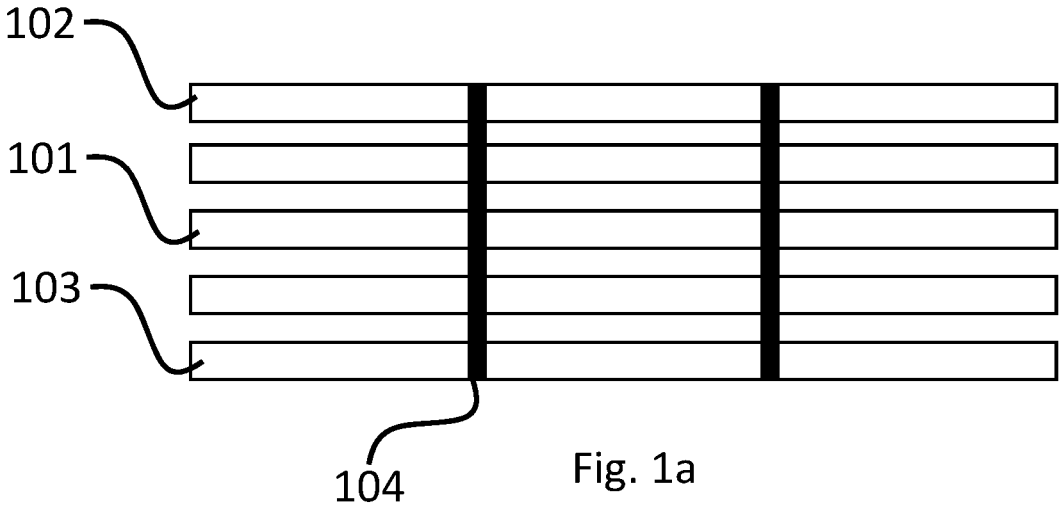
FIG. 1*a* shows a schematic representation of a cross-section through a portion of a duvet in accordance with an embodiment of the present invention.
Figure 1B:
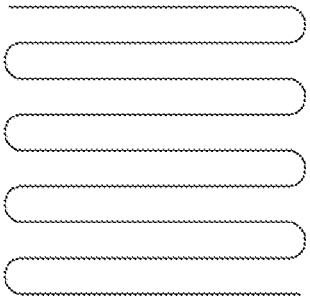
FIG. 1*b* shows a schematic representation of the manner in which layers of insulation are lapped over one another to form the desired thickness of insulation.
Figure 2:
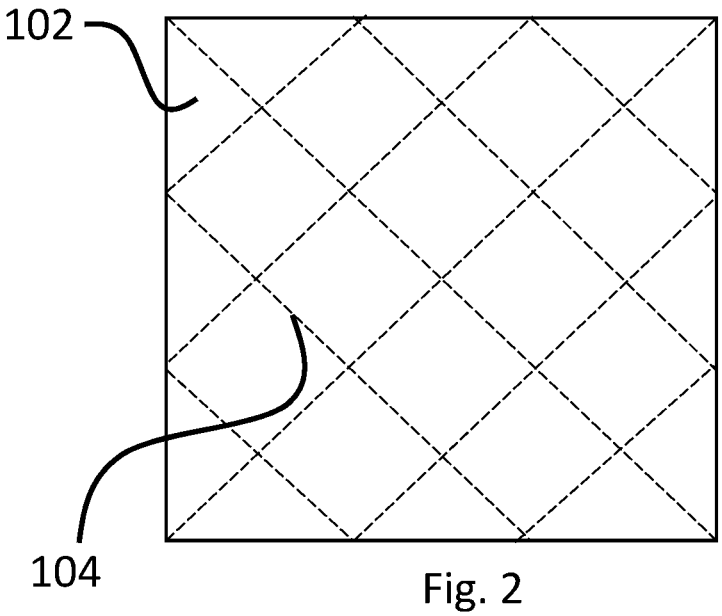
FIG. 2 shows a schematic representation of a plan view of the portion of the duvet shown in FIG. 1.

Referring to FIGS. 1*a*, 1*b* and 2, an exemplary product that employs a fill material in accordance with an embodiment of the present invention will be described. FIG. 1*a* schematically shows a cross-section through a portion of the product and FIG. 2 schematically shows a plan view of the portion.

As can be seen, the product has a layered structure in which multiple layers 101 of the fill material are encapsulated between top and bottom cover layers 102, 103. The cover layers 102, 103 may be secured to one another, and to the insulating fill material layers 101, using lines of stitching 104 that pass through the layered structure from top to bottom. The layers 101 are formed from a single continuous web of the fill material that are lapped over one another, as shown schematically in FIG. 1*b*

In this example, the fill material is a blend of 65% cashmere guard hair and 35% alpaca, although Lambswool and/or Merino wool could be used as an alternative. Other percentage blends may be used.

The blended fibres are formed into a non-woven web, with each fine, transparent layer of the web gently folded over the previous layer to form the desired thickness, insulating properties and weight of filling. Three layers of insulation are shown in FIG. 1*a* for illustrative purposes but typically there will be more, possibly many more, layers than this (e.g. at least 10 and as many as 40 or more where heavier weights are wanted).

The two cover layers in this example are formed from a 100% cotton fabric. Other materials may be used. A cotton thread is used for the stitches through the layered structure that hold the structure together.

Figure 3:
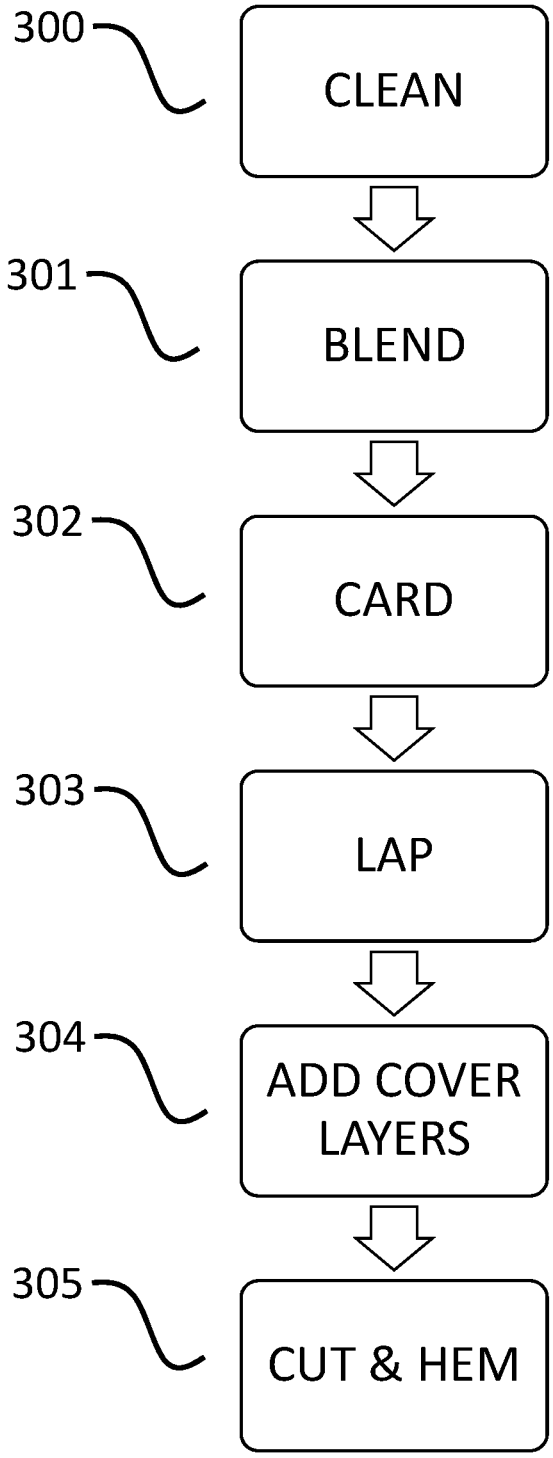
FIG. 3 illustrates the main steps in a process for manufacturing a duvet in accordance with an embodiment of the present invention.

FIG. 3 illustrates the steps in an exemplary process for manufacturing a layered product as shown in FIGS. 1*a*, 1*b* and 2, using the insulating fill material of the present invention.

Greasy cashmere is typically combed or sheared from the goat in early spring. The greasy cashmere is sorted into shade (Dark Brown, Medium Brown, Fawn and White/Light Grey) and checked for any contamination. The greasy cashmere is then mechanically opened, and dedusted prior to scouring through a six bowl scouring line, using bio degradable detergent and the addition of 1% formaldehyde solution in the last rinse bowl to kill any bacteria present in the raw cashmere. The scoured cashmere is then dried using a gas fueled hot air system, following which it is put through another opener and deduster, to remove more sand and dust. The scoured cashmere is then further opened before dehairing to separate the fine down and guard hair.

Normally, the guard hair is discarded and the fine down goes on to be used in the manufacture of luxury cashmere scarves, fabric and accessories. Embodiments of the present invention, however, make use of the guard hair.

Once the guard hair has been obtained as a by-product of the conventional process described above, in a first step 300 of a process for making an insulating fill material in accordance with an embodiment of the present invention, the guard hair is scoured again, dried and dedusted two or three times (e.g. by passing over a shaker machine) to remove sand, dead skin and vegetable matter that might still be caught up in the guard hair fibres.

In a second step 301 cashmere guard hair fibre is blended with either alpaca or wool. The blending may be by hand or machine. To provide the desired finished blend of about 65% guard hair and 35% alpaca/wool, it is generally necessary to start the blending step with a higher percentage of guard hair, e.g. with 75% cashmere guard hair and 25% wool. This is because, due to the nature of the cashmere guard hair (in particular its fineness and straightness), a proportion falls through the carding machine during processing, leaving the desired final blend.

In the next step 302, the blended material is passed through a carding machine to create a non-woven web. Carding is a well-known conventional processing method used to straighten the fibres, aligning them all in the same direction, to remove any remaining 'scurf' (vegetable matter and dead skin), and intermix fibres to produce a continuous, non-woven web. Conventional carding machines may be used in the present example.

Once the non-woven web has been formed, the next step 303 is to lap the web to build up layers of the web to give the desired thickness of fill material. This can be done using a conventional lapping machine, which folds the web back and forth on itself to form multiple pleats to layer the web on top of itself.

The fill material can then be incorporated into a product, for example a duvet, by adding appropriate cover layers, for example cotton fabric layers. A multi head sewing machine can be used to stitch lines through two outer layers of fabric, one above and the other below the fill material. This is shown as step 304 in FIG. 3. In FIG. 2, these stitch lines are shown in a diamond pattern but other stitching patterns can be used, for example S-shape (or serpentine) stich lines running along the length of the fabric layers.

In a final step 305, the composite layered material piece formed in step 304 can then be cut to a desired shape and size and the edges of the cut piece hemmed to close the edges of the cover layer around the fill material to form the finished product.

The skilled person will understand that various modifications and additions can be made to the example described above without departing from the spirit and scope of the present invention. For instance, other treatments may be applied to the fill material prior to it being incorporated into a finished product, for example treatments to ensure the fill material is washable (i.e. so that the fibre does not shrink or change character when washed). Similarly, steps other than those described above may be incorporated into the process for manufacturing the finished product, for example to add decorative elements or patterns to the cover layers.

The invention claimed is:

1. An insulating fill material comprising a blend of fibres, the fibres comprising cashmere guard hair, wherein:

at least 50% of the blended fibres are cashmere guard hair; and the blended fibres are in the form of a non-woven web formed by carding the blended fibres, the fill material comprising a plurality of layers formed from a single continuous web of the fill material that are lapped over one another.

2. A fill material according to claim 1, wherein 65% of the blended fibres are cashmere guard hair.

3. A fill material according to claim 1, wherein at least 30% of the blended fibres are fibres other than cashmere guard hair.

4. A fill material according to claim 1, wherein the blended fibres comprise other natural fibres in addition to the cashmere guard hair.

5. A fill material according to claim 4, wherein the other natural fibres comprise one or more of sheep wool, merino wool and alpaca.

6. A product comprising a fill material according to claim 1 retained between two fabric cover layers.

7. A product according to claim 6, wherein the product is a bedding product or a garment.

8. A product according to claim 7, wherein the product is a duvet.

9. A product according to claim 6, wherein the cover layers are joined to one another by stitches that pass through the fill material.

10. A product according to claim 6, in which the cover layers are 100% cotton.

* * * * *